US009991620B1

(12) United States Patent
Boyer et al.

(10) Patent No.: US 9,991,620 B1
(45) Date of Patent: Jun. 5, 2018

(54) ELECTRICAL CABLE CONNECTOR

(71) Applicant: Delphi Technologies, Inc., Troy, MI (US)

(72) Inventors: Richard J. Boyer, Mantua, OH (US); John F. Heffron, Youngstown, OH (US); Evangelia Rubino, Warren, OH (US); Duane L. Brantingham, Cortland, OH (US); Zachary J. Richmond, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days. days.

(21) Appl. No.: 15/604,812

(22) Filed: May 25, 2017

(51) Int. Cl.

| | |
|---|---|
| ***H01R 13/64*** | (2006.01) |
| ***H01R 13/28*** | (2006.01) |
| ***H01R 13/627*** | (2006.01) |
| ***H01R 43/20*** | (2006.01) |
| ***H01R 43/26*** | (2006.01) |

(52) U.S. Cl.
CPC ..... *H01R 13/28* (2013.01); *H01R 13/6272* (2013.01); *H01R 43/20* (2013.01); *H01R 43/26* (2013.01)

(58) Field of Classification Search
CPC ..... H01R 12/714; H01R 13/22; H01R 13/14; H01R 13/2407; H01R 13/2414; H01R 13/2421
USPC ..... 439/289, 930, 357
See application file for complete search history.

(56) References Cited

U.S. PATENT DOCUMENTS

| | | | | |
|---|---|---|---|---|
| 2,595,057 A * | 4/1952 | Cotter | F16G 11/048 | 174/84 S |
| 4,842,544 A * | 6/1989 | Birch | H01R 9/034 | 439/374 |
| 5,372,525 A * | 12/1994 | Wu | H01R 33/09 | 439/656 |
| 6,007,356 A * | 12/1999 | Stein | H01R 4/5025 | 439/284 |

* cited by examiner

*Primary Examiner* — Phuong Dinh
(74) *Attorney, Agent, or Firm* — Robert J. Myers

(57) ABSTRACT

An electrical connector assembly is presented herein. The electrical connector includes a pair of connector blocks each defining a groove in an end surface that is configured to have an electrical conductor of an electrical cable partially disposed within it, e.g. a carbon nanotube conductor. The electrical connector also includes a housing configured to receive connector blocks, align the groove of one connector block with the groove of the other connector block, and hold the connector blocks together such that the electrical conductors within the grooves are in direct physical and electrical contact with the one another and are compressed. An electrical cable assembly incorporating such as connector and an method of manufacturing a cable assembly using such a connector is also presented.

27 Claims, 8 Drawing Sheets

ELECTRICAL CABLE CONNECTOR

TECHNICAL FIELD OF THE INVENTION

The invention generally relates to a connector configured to interconnect electrical cables, and more particularly relates to an electrical cable connector which connects one cable directly to another without separate terminals.

BACKGROUND OF THE INVENTION

Traditionally automotive electrical cables were made with copper wire conductors which may have a mass of 15 to 28 kilograms in a typical passenger vehicle. In order to reduce vehicle mass to meet vehicle emission requirements, automobile manufacturers have begun also using aluminum conductors. However, aluminum wire conductors have reduced break strength and reduced elongation strength compared to copper wire of the same size and so are not an optimal replacement for wires having a cross section of less than 0.75 $mm^2$ (approx. 0.5 mm diameter). Many of the wires in modern vehicles are transmitting digital signals rather than carrying electrical power through the vehicle. Often the wire diameter chosen for data signal circuits is driven by mechanical strength requirements of the wire rather than electrical characteristics of the wire and the circuits can effectively be made using small diameter wires.

Stranded carbon nanotubes (CNT) are lightweight electrical conductors that could provide adequate strength for small diameter wires. However, CNT strands do not currently provide sufficient conductivity for most automotive applications. CNT strands are not easily terminated by conventional crimped on terminals due to concerns about galvanic corrosion caused by contact of dissimilar materials in the presence of electrolytes. Additionally, CNT strands are not terminated without difficulty by soldered on terminals because they do not wet easily with solder.

Therefore, a lower mass alternative to copper wire conductors for small gauge wiring remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical connector assembly is provided. The electrical connector assembly includes a first connector block defining a first groove in a first end surface of the first connector block and a second connector block defining a second groove in a second end surface of the second connector block. The first connector block is configured to have a first electrical conductor at least partially disposed within the first groove and the second connector block is configured to have a second electrical cable having a second conductor at least partially disposed within the second groove. The electrical connector assembly also includes a housing that is configured to receive the first and second connector blocks. The housing is also configured to align the first groove of the first connector block with the second groove of the second connector block. This housing is further configured to hold the first and second connector blocks together such that the first electrical conductor is in direct physical and electrical contact with the second conductor and such that the first and second conductors are compressed by one another.

The housing may include a male portion defining a first cavity in which the first connector block is received and a separate female portion defining a second cavity in which the second connector block is received. The female portion further defines a shroud that is configured to receive the male portion. The male portion and the female portion may have corresponding locking features configured to secure the male portion to the female portion.

The first groove may continuously extend from the first end surface to a first side surface of the first connector block adjacent the first end surface and the second groove may continuously extend from the second to a second side surface of the second connector block adjacent the second end surface. The first connector block may be identical to the second connector block.

The housing may be dimensioned such that the first and second connector blocks cause an interference fit condition between the first and second conductors. Alternatively or additionally, the housing may include a spring element configured to exert a compressive force on the first and second connector blocks, thereby causing an interference fit condition between the first and second conductors. Alternatively or additionally, the housing may include a wedge-shaped element configured to exert a compressive force on the first and second connector blocks, thereby causing an interference fit condition between the first and second conductors.

In accordance with another embodiment of the invention, an electrical cable assembly configured for transmission of differential signals is provided. The electrical cable assembly includes a first connector block defining a first pair of grooves in a first end surface of the first connector block and a first electrical cable having a first pair of electrical conductors formed of carbon nanotubes and longitudinally twisted one about the other. Each conductor of the first pair of electrical conductors is separately at least partially disposed within one of the first pair of grooves. The electrical cable assembly also includes a second connector block defining a second pair of grooves in a second end surface of the second connector block and a second electrical cable having a second pair of electrical conductors formed of carbon nanotubes and longitudinally twisted one about the other. Each conductor of the second pair of electrical conductors is separately at least partially disposed within one of the second pair of grooves.

The electrical cable assembly further includes a male housing defining a first cavity in which the first connector block is received and a female housing defining a second cavity in which the second connector block is received and further defining a shroud configured to receive the male housing. The male housing and the female housing cooperate to align the first pair of grooves of the first connector block with the second pair of grooves of the second connector block and hold the first and second connector blocks together such that the first pair of electrical conductors are in direct physical and electrical contact with the second pair of electrical conductors such that the first and second pairs of conductors are compressed. The male housing and the female housing may have corresponding locking features configured to secure the male housing to the female housing. The first connector block may be identical to the second connector block.

The first pair of grooves may continuously extend from the first end surface to a first side surface of the first connector block adjacent the first end surface and the second pair of grooves may continuously extend from the second end surface to a second side surface of the second connector block adjacent the second end surface. The first pair of grooves may further continuously extend from the first end surface to a third side surface of the first connector block adjacent the first end surface and opposite the first side surface and the second pair of grooves may further continuously extend from the second end surface to a fourth side surface of the second connector block adjacent the second end surface and opposite the second side surface.

The male housing and the female housing are dimensioned such that the first and second connector blocks cause an interference fit condition between the first and second pairs of conductors. Alternatively or additionally, the male housing and/or the female housing may include a spring element configured to exert a compressive force on the first and second connector blocks, thereby causing an interference fit condition between the first and second pairs of conductors. Alternatively or additionally, the male housing and/or the female housing may include a wedge-shaped element configured to exert a compressive force on the first and second connector blocks, thereby causing an interference fit condition between the first and second conductors.

In accordance with yet another embodiment of the invention, a method of interconnecting a first electrical cable to a second electrical cable is provided. The method includes the steps of providing a first connector block defining a first groove in a first end surface of the first connector block, providing a first electrical cable and at least partially disposing the first electrical cable within the first groove, providing a second connector block defining a second groove in a second end surface of the second connector block, providing a second electrical cable and at least partially disposing the second electrical cable within the second groove, providing a housing configured to receive the first and second connector blocks, inserting the first and second connector blocks within the housing such that the first groove of the first connector block is aligned with the second groove of the second connector block, holding the first and second connector blocks together such that the first electrical cable is in direct physical and electrical contact with the second electrical cable, and compressing the first and second conductors through the direct physical contact with one another. The first connector block may be identical to the second connector block.

The housing may include a male portion defining a first cavity and a female portion defining a second cavity in which the second connector block is received and defining a shroud configured to receive the male portion and the method may further comprises the steps of inserting the first connector block within the first cavity and inserting the second connector block within the second cavity.

The male portion and the female portion may have corresponding locking features and the method may further include the step of securing the male portion to the female portion via the locking features.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Carbon nanotube (CNT) conductors provide improved strength and reduced density as compared to stranded metallic conductors. CNT strands have 160% higher tensile strength compared to a copper strand having the same diameter and 330% higher tensile strength compared to an aluminum strand having the same diameter. In addition, CNT strands have 16% of the density of the copper strand and 52% of the density of the aluminum strand.

Figure 1:
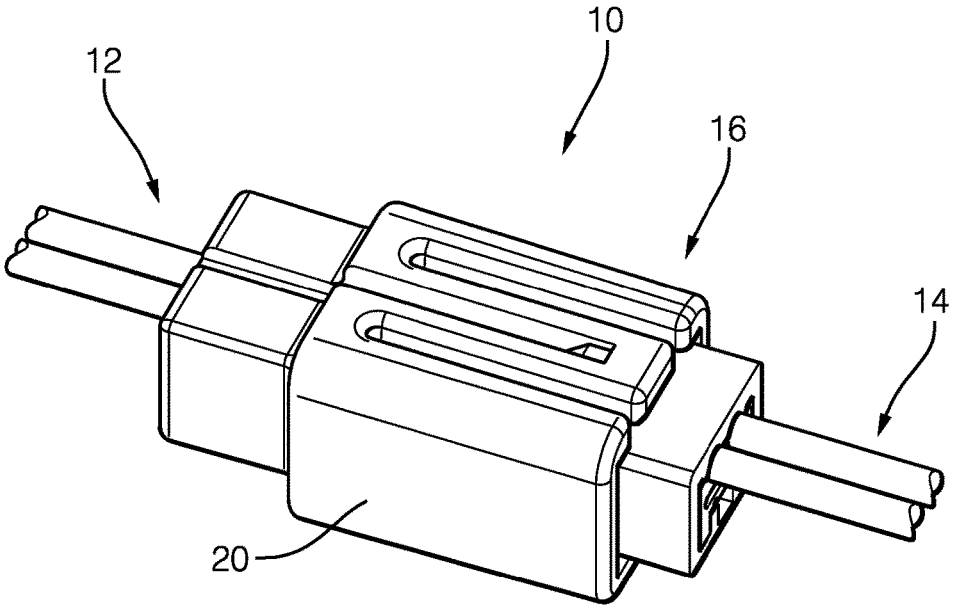
FIG. 1 is a perspective view of an electrical cable assembly in accordance with one embodiment.
Figure 2:
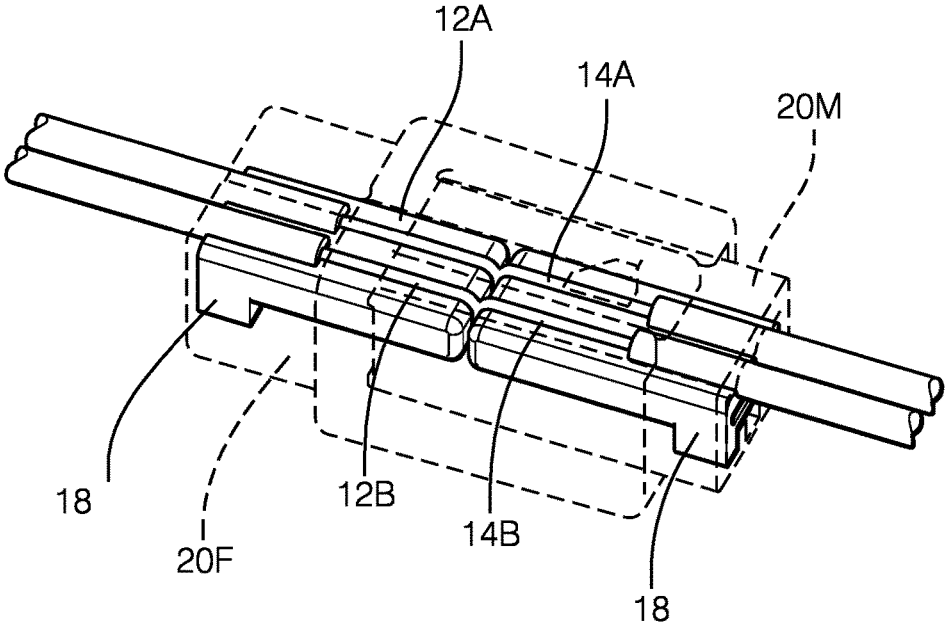
FIG. 2 is a cross section perspective view of electrical cable assembly of FIG. 1 showing a pair of conductors wrapped over an end of a connector block in compressive contact with another pair of conductors wrapped over an end of another connector block in accordance with one embodiment.

FIG. 1 illustrates a non-limiting example of an electrical cable assembly 10 that is suited for the transmission of digital signals. It is particularly well suited for transmission of differential digital signals. The electrical cable assembly 10 may also be well suited to transmission of low-level analog audio signals, e.g. connecting an audio source such as a receiver to an external amplifier. The assembly includes two electrical cables 12, 14 having pairs of conductors 12A, 12B, 14A, 14B that are formed of carbon nanotubes and enclosed within insulative jackets 12C, 12D, 14C, 14D. The pairs of conductors 12A, 12B, 14A, 14B are twisted one about the other for the purposes of canceling out electromagnetic interference (EMI) from external sources. The two electrical cables 12, 14 are joined by an electrical connector assembly 16 in which the pair of conductors 12A, 12B, 14A, 14B of each of the electrical cables 12, 14 are wrapped over the end of a connector block 18 and are held in direct contact with each other by a housing 20 as shown in FIG. 2. The housing 20 comprises a male housing 20M holding one of the connector blocks 18 and a female housing 20F holding the other connector block 18 and configured to receive and attach to the male housing 20M. The conductors 12A, 12B, 14A, 14B are not terminated by separate terminals attached to the ends of the conductors 12A, 12B, 14A, 14B.

Figure 3:
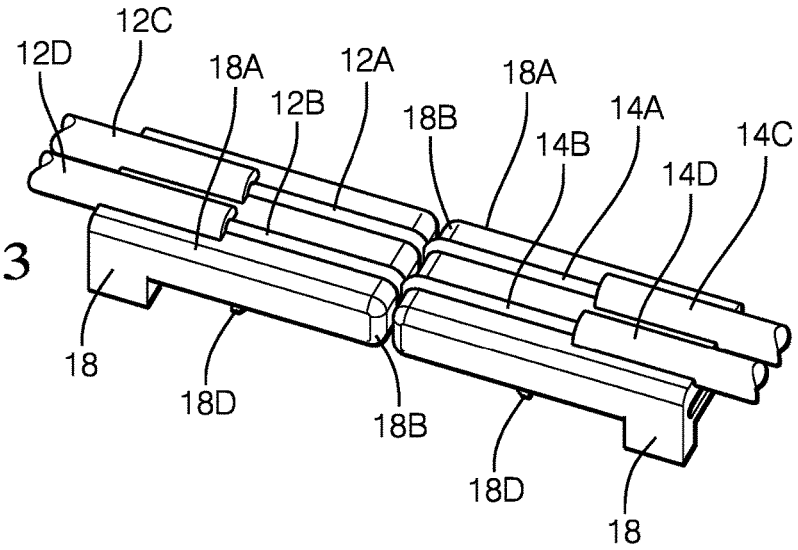
FIG. 3 is an isolated perspective view of the connector blocks and conductors of FIG. 2 in accordance with one embodiment.
Figure 4:
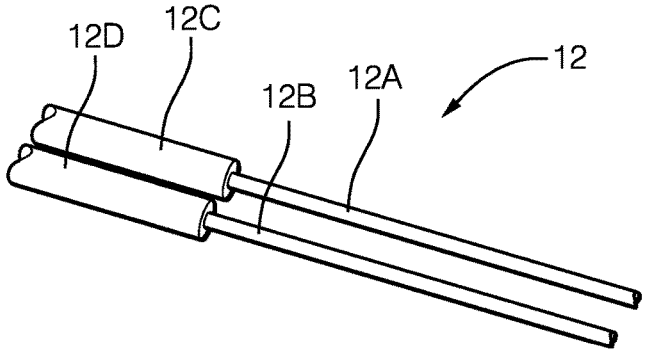
FIG. 4 is a perspective view of a pair electrical cables with exposed inner conductors in accordance with one embodiment.
Figure 5A:
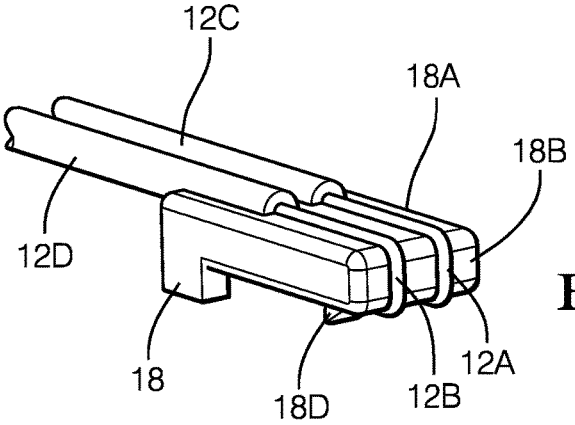
FIG. 5A is a perspective top view of a pair electrical cables of FIG. 4 wrapped about the connector block of FIG. 3 in accordance with one embodiment.
Figure 5B:
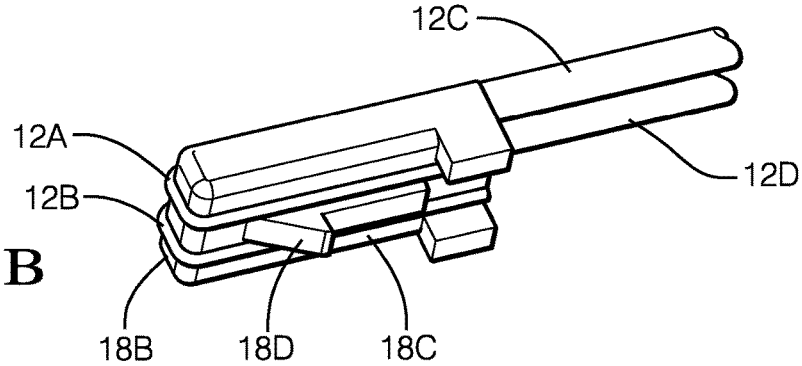
FIG. 5B is a perspective bottom view of a pair electrical cables of FIG. 4 wrapped about the connector block of FIG. 3 in accordance with one embodiment.

As illustrated in FIG. 3, the electrical cable assembly 100 includes a pair of connector blocks 18 that are formed of a dielectric, i.e. electrically insulative, material such as polyamide (PA, NYLON) or polybutylene terephthalate (PBT). In the illustrated example, both connector blocks 18 are identical to one another. However, alternative embodiments may be envisioned in which the design of each of the connectors blocks are different. As illustrated in FIG. 4, a portion of the insulative jackets 12C, 12D, 14C, 14D is removed from each of the electrical cables 12, 14, exposing the carbon nanotube conductors 12A, 12B, 14A, 14B. As best shown in FIGS. 5A and 5B, each connector block 18 defines a pair of conductor grooves (not directly shown due to the conductors 12A, 12B, 14A, 14B contained within) that continuously extending from the top surface 18A, to the end surface 18B, and then to the bottom surface 18C of the connector block 18. Each conductor groove has a generally semicircular cross sectional profile. One of the exposed conductors 12A, 12B, 14A, 14B is disposed within each of the conductor grooves. The connector block 18 also defines a pair of larger cable grooves (again not directly shown due to the insulative jackets 12C, 12D, 14C, 14D contained within) extending from the conductor grooves that are configured to contain a portion of the electrical cables 12, 14 from which the insulative jackets 12C, 12D, 14C, 14D has not been removed. The conductors 12A, 12B, 14A, 14B may be held within the conductor grooves by clips, snap features, or adhesives.

Figure 6A:
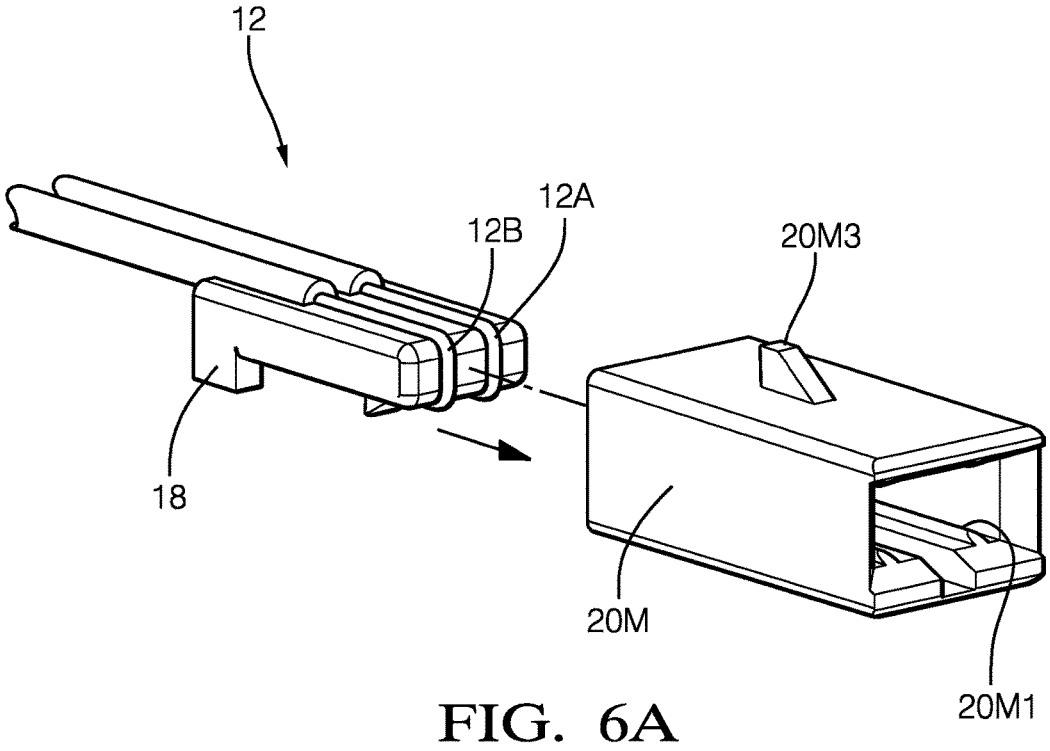
FIG. 6A is a perspective exploded view of a pair of conductors wrapped over an end of a connector block and a male housing in accordance with one embodiment.
Figure 6B:
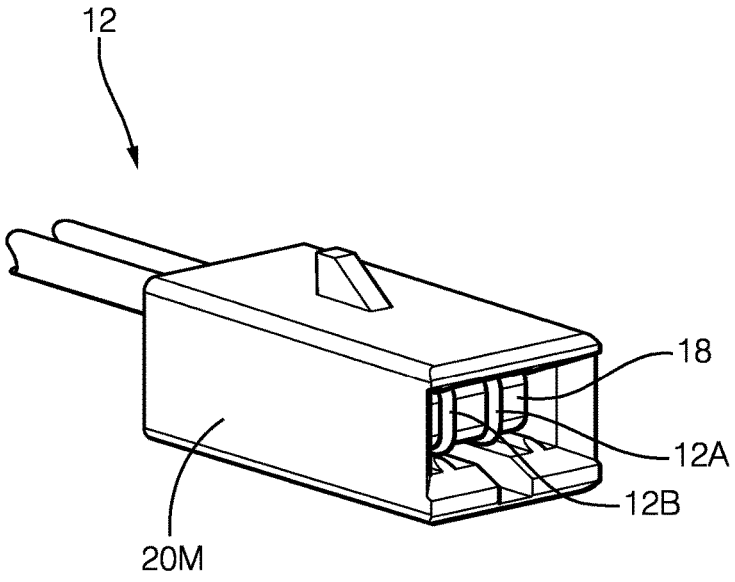
FIG. 6B is a perspective assembled view of the pair of conductors wrapped over an end of the connector block and the male housing of FIG. 6A in accordance with one embodiment.

As illustrated in FIGS. 6A and 6B, after the conductors 12A, 12B, 14A, 14B are placed into the connector grooves of the connector blocks 18 (see FIGS. 5A and 5B), one of the conductor wrapped connector blocks 18 is placed within a cavity 20M1 defined by the male housing 20M. This male housing 20M is also formed on an insulative material, such as PA or PBT, and may or may not be formed of the same material as the connector block 18. The male housing 20M includes a flexible lock arm 20M2 that engages the triangular lock tab 18D extending from the bottom surface 18C of the connector block 18 to secure the wrapped connector block 18 with the cavity 20M1 of the male connector 20M.

Figure 7A:
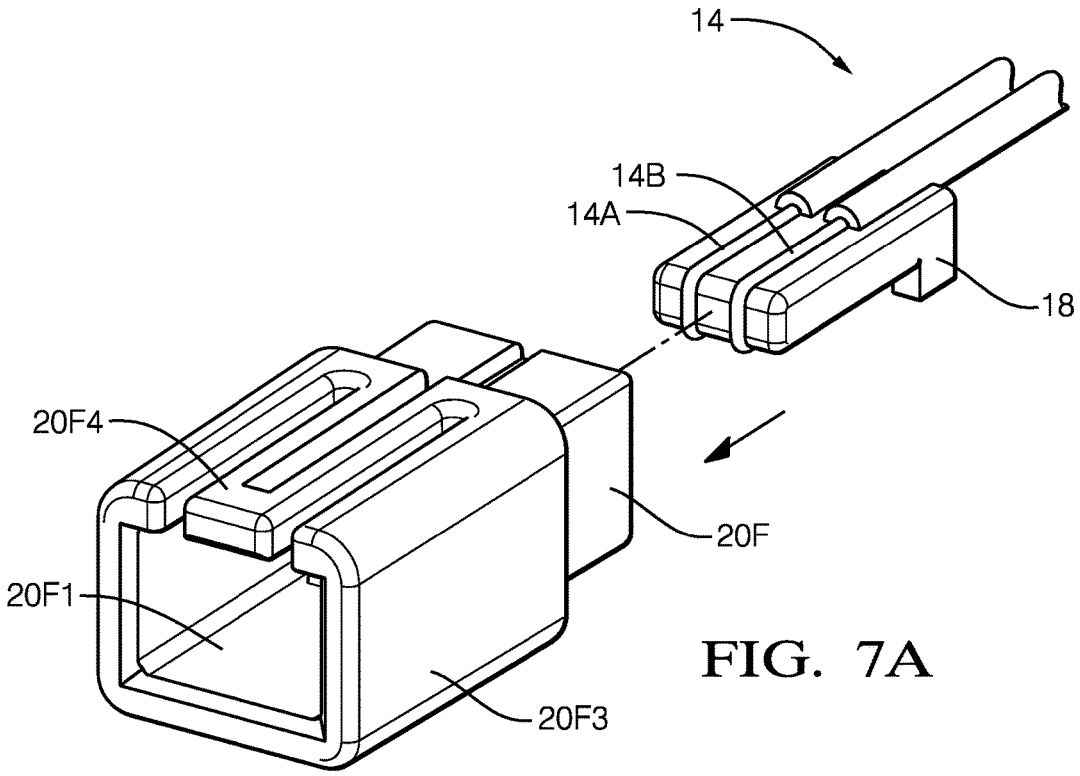
FIG. 7A is a perspective exploded view of a pair of conductors wrapped over an end of a connector block and a female housing in accordance with one embodiment.
Figure 7B:
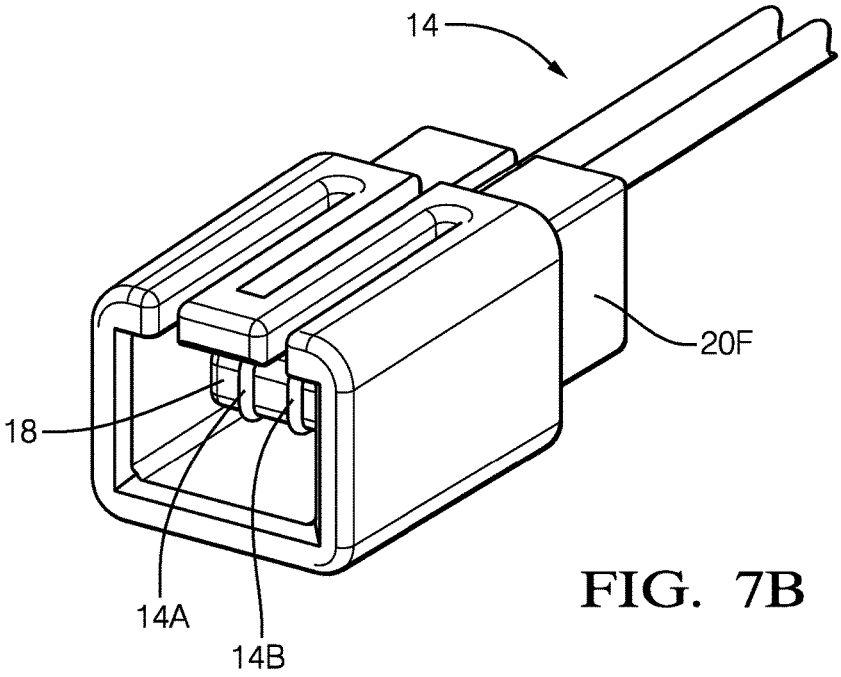
FIG. 7B is a perspective assembled view of the pair of conductors wrapped over an end of the connector block and the female housing of FIG. 7A in accordance with one embodiment.

As illustrated in FIGS. 7A and 7B, the other wrapped connector block 18 is placed within a cavity 20F1 defined by the female housing 20F. The female housing 20F is also formed on an insulative material, such as PA or PBT, and may or may not be formed of the same material as the connector block 18 and/or the male housing 20M. The female housing 20F similarly includes a flexible lock arm 20F2 that engages the triangular lock tab 18D extending from the bottom surface 18C of the connector block 18 to secure the wrapped connector block 18 with the cavity 20F1 of the female housing 20F.

Figures 8A, 8B:
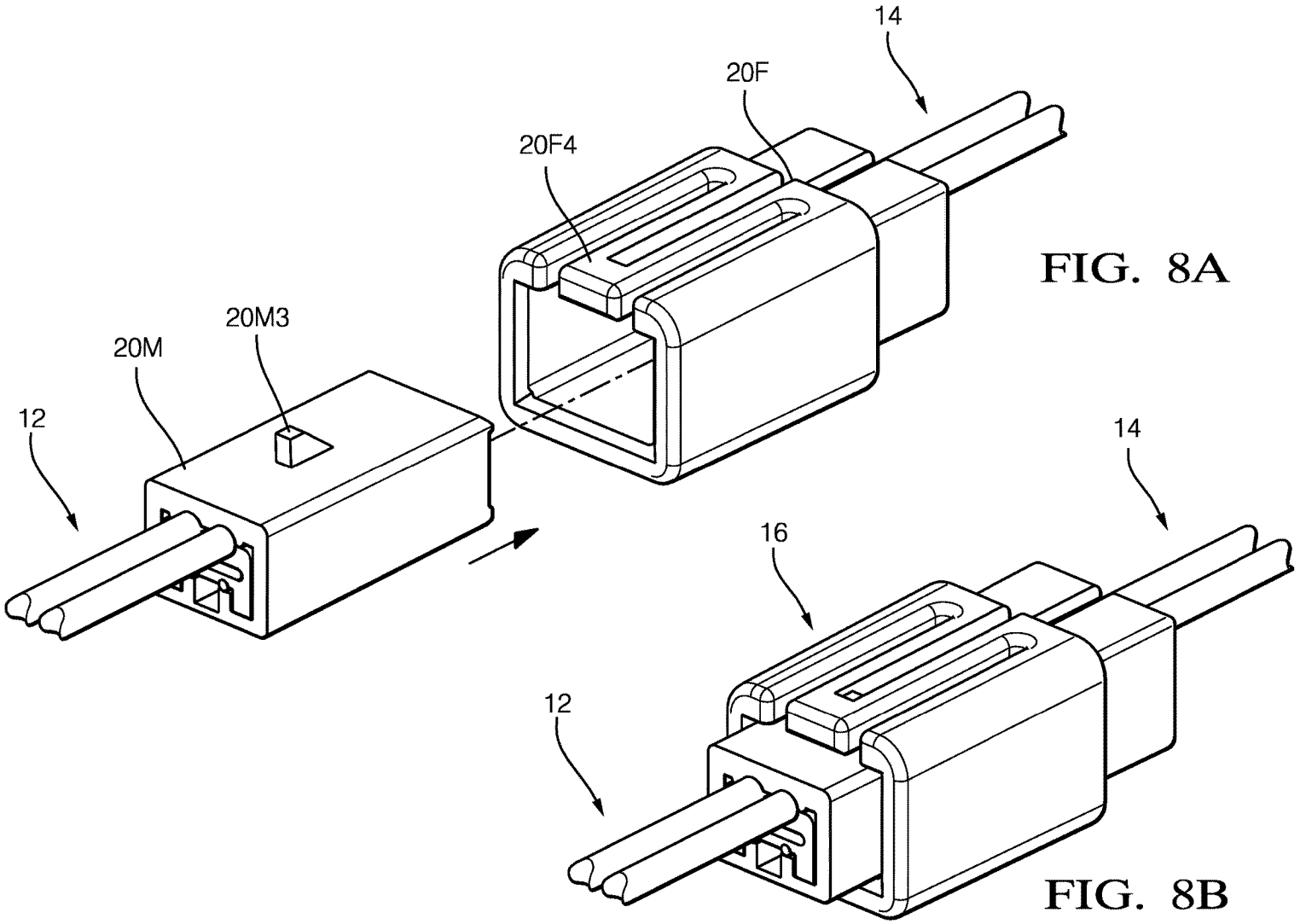
FIG. 8A is a perspective exploded view of the assembly of FIG. 6B and the assembly of FIG. 7B in accordance with one embodiment.
FIG. 8B is perspective assembled view of the assembly of FIG. 6B and the assembly of FIG. 7B in accordance with one embodiment.

As shown in FIGS. 8A and 8B, after the two wrapped connector blocks 18 are secured within the male and female housings 20M, 20F, the male housing 20M is joined with the female housing 20F by placing the male housing 20M within the shroud 20F3 of the female housing 20F and engaging the lock tab 20M3 extending the top surface of the male housing 20M with the flexible lock arm 20F4 defined in the top surface of the female housing 20F. The male and female housings 20M, 20F cooperate so that each of the conductors 12A, 12B in the conductor pair of one of the electrical cables 12 is aligned with the one of the corresponding conductors 14A, 14B in the conductor pair of the other electrical cable 14. The positioning of the connector blocks 18 in the housing 20 puts the conductors 12A, 12B of one electrical cable 12 in direct physical and electrical contact with the conductors 14A, 14B of the other electrical cable 14. The connector blocks 18 and housing 20 are dimensioned such that conductors 12A, 12B, 14A, 14B of each of the electrical cables 12, 14 are in compression against each other. Compaction of the carbon nanotube cables has also been theorized to improve conductivity due to removal of free space between the carbon nanotubes in the cable.

Figure 9A:
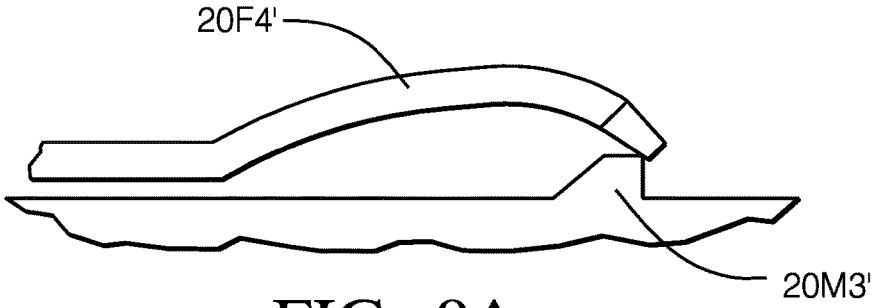
FIGS. 9A-9C are cross section perspective views of the electrical cable assembly of FIG. 1 including a spring feature in accordance with another embodiment.
Figure 9B:
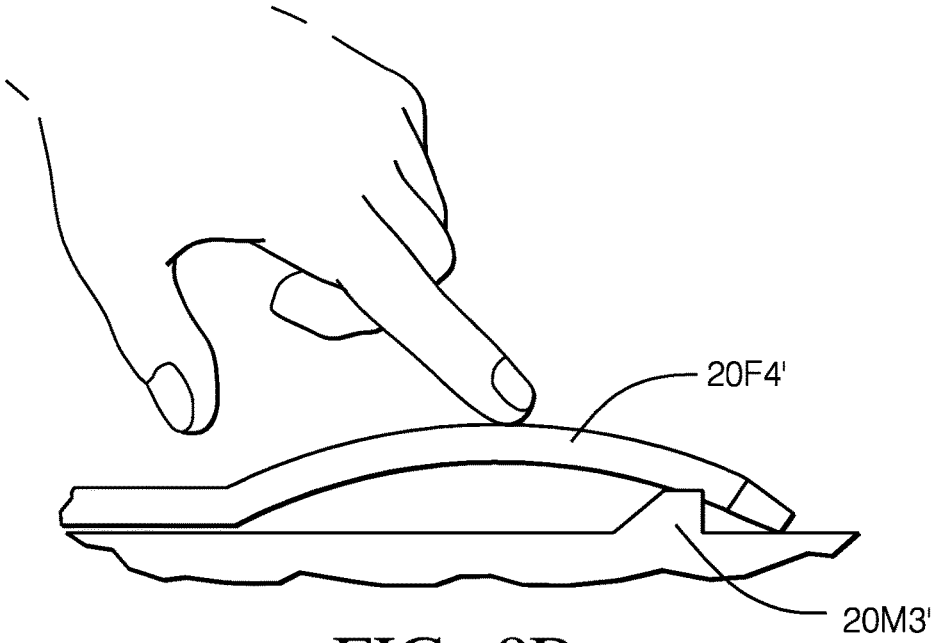
Figure 9C:
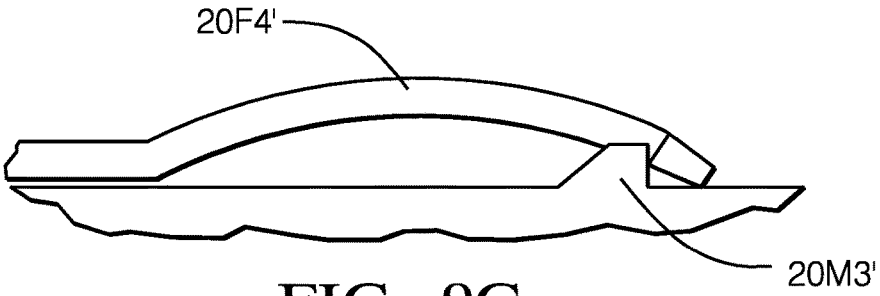

FIGS. 9A-9C illustrate an alternate embodiment of the electrical connector assembly 16' in which a spring feature is provided by the lock arm 20F4' of the female housing 20F' having a arcuate shape as shown in FIG. 9A that is configured to exert a spring force on the male and female housings 20F', 20M', thereby transmitting the spring force to the connector blocks 18 to compress the conductors 12A, 12B, 14A, 14B against each other. The lock arm 20F4' is depressed as shown in FIG. 9B to extend the lock arm 20F4' in order to engage the lock arm 20F4' with the lock tab 20M3' on the male housing 20M' as the male housing 20M' is mated with the female housing 20F'. After the lock tab 20M3' of the male housing 20M' is engaged with the lock arm 20F4' of the female housing 20F, the lock arm 20F4' is released allowing it to nearly return to its previous shape, thereby exerting the spring force on the male and female housings 20M, 20F and therefore the connector blocks 18. The spring feature may alternatively or additionally be applied to the flexible lock arm 20F2' of the female housing 20F' and the flexible lock arm 20M2' of the male housing 20M' to exert the spring force directly to the connector blocks 18 through the lock tabs 18D. This spring feature may be used as an alternative to the dimensioning in electrical connector assembly 16 described above or in addition to the dimensioned features. Additional alternative embodiments may employ other types of springs including integrally or separately formed leaf or coil springs.

Figure 10A:
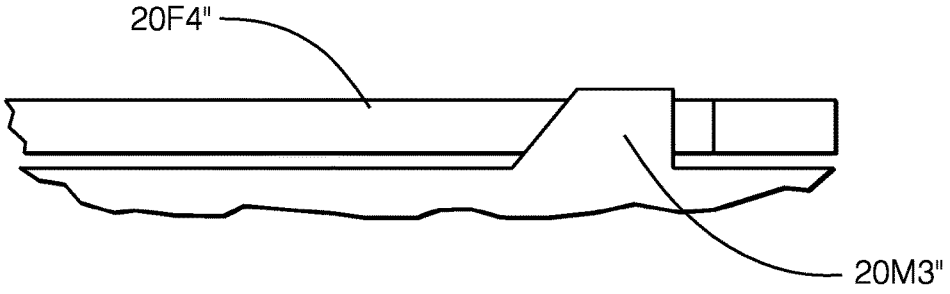
FIGS. 10A & 10B are cross section perspective views of the electrical cable assembly of FIG. 1 including a wedge feature in accordance with yet another embodiment.
Figure 10B:
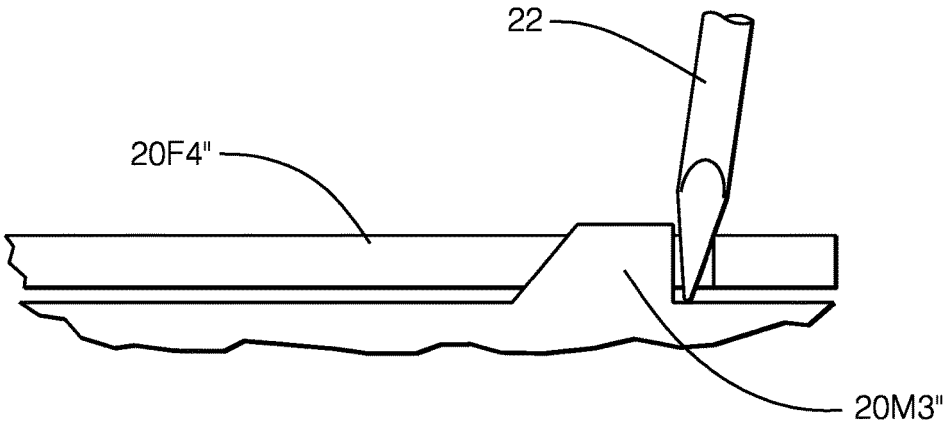

FIGS. 10A and 10B illustrate yet another alternate embodiment of the electrical connector assembly 16" in which a wedge feature 22 is inserted between the lock arm 20F4" of the female housing 20F" and the lock tab 20M3" of the male housing 20M" to exert an longitudinal compressive force on the male and female housings 20F", 20M", thereby transmitting the longitudinal compressive force to the connector blocks 18 to compress the conductors 12A, 12B, 14A, 14B against each other as shown in FIG. 10B. The wedge feature 22 may be incorporated into a connector position assurance (CPA) device. The wedge feature 22 may alternatively or longitudinal compressively be applied to the flexible lock arm 20F2" of the female housing 20F" and/or the flexible lock arm 20M2" of the male housing 20M" to exert the longitudinal compressive force directly to the connector blocks 18 through the lock tabs 18D. This wedge feature 22 may be used as an alternative or in addition to the techniques used in electrical connector assembly 16 and/or electrical connector assembly 16' to apply compressive force to the conductors 12A, 12B, 14A, 14B.

Yet other alternative embodiments may employ wedge features inserted between the lock arms 20F2, 20M2 of the male and female housings 20F, 20M respectively and the lock tabs 18D of the connector blocks 18.

Figure 11:
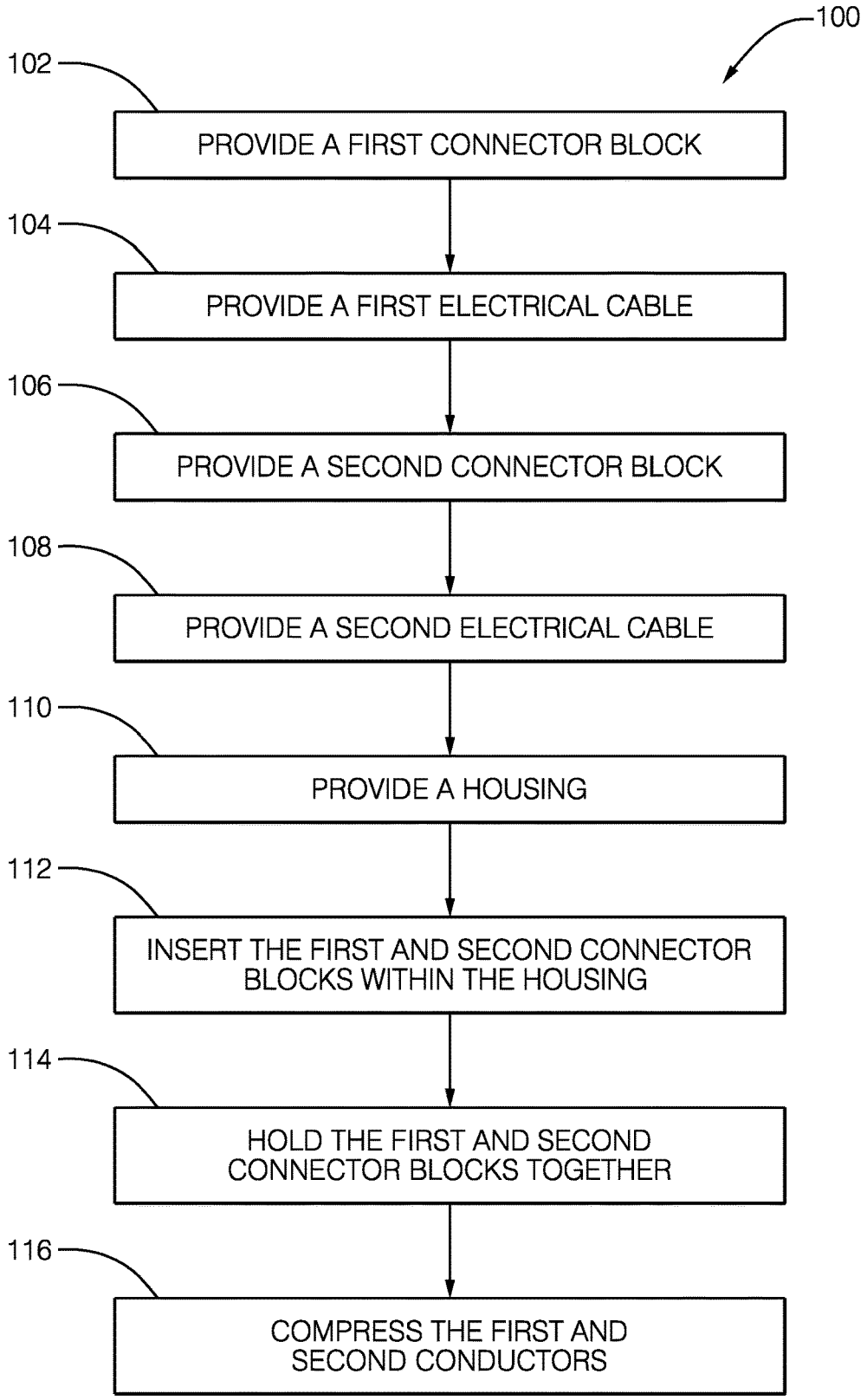
FIG. 11 is a flow chart of a method of interconnecting a first electrical cable to a second electrical cable in accordance with a different embodiment.

FIG. 11 illustrates a non-limiting method 100 of interconnecting a first electrical cable 12 to a second electrical cable 14. The method 100 includes the following steps.

STEP 102, PROVIDE A FIRST CONNECTOR BLOCK, includes providing a first connector block 18 defining a first groove in a first end surface 18B of the first connector block 18 as shown in FIGS. 5A and 5B.

STEP 104, PROVIDE A FIRST ELECTRICAL CABLE, includes providing a first electrical cable 12 and at least partially disposing the first electrical cable 12 within the first groove of the first connector block 18 as shown in FIG. 4 and FIGS. 5A and 5B.

STEP 106, PROVIDE A SECOND CONNECTOR BLOCK, includes providing a second connector block 18 defining a second groove in a second end surface 18B of the second connector block 18 as shown in FIGS. 5A and 5B.

STEP 108, PROVIDE A SECOND ELECTRICAL CABLE, includes providing a second electrical cable 14 and at least partially disposing the second electrical cable 14 within the second groove of the second connector block 18 as shown in FIG. 4 and FIGS. 5A and 5B.

STEP 10, PROVIDE A HOUSING, includes providing a housing 20 configured to receive the first and second connector blocks 18. The housing 20 has a male portion 20M and a female portion 20F as illustrated in FIGS. 6A and 7A.

STEP 112, INSERT THE FIRST AND SECOND CONNECTOR BLOCKS WITHIN THE HOUSING, includes inserting the first and second connector blocks 18 within the housing 20 such that the first groove of the first connector block 18 is aligned with the second groove of the second connector block 18, thereby aligning the first electrical cable 12 with the second electrical cable 14 as shown in FIG. 2.

STEP 114, HOLD THE FIRST AND SECOND CONNECTOR BLOCKS TOGETHER includes holding the first and second connector blocks 18 together such that the first conductor 12A is in direct physical and electrical contact with the second conductor 14A as shown in FIG. 2.

STEP 116, COMPRESS THE FIRST AND SECOND CONDUCTORS includes compressing the first and second conductors 12A, 14A through the direct physical contact with one another.

While the examples shown herein include wire cables formed of carbon nanotubes, other embodiments of the invention that include copper wire cables or aluminum wire cables may also be envisioned.

Accordingly, an electrical connector assembly 16, an electrical cable assembly 10 configured for transmission of differential signals, and method 100 of interconnecting a first electrical cable 12 to a second electrical cable 14 are provided. These assemblies 10, 16 and methods 100 provide the benefits of providing an interconnection between electrical cables 12, 14 that does not include separate terminals attached to the ends of each electrical cable 12, 14, saving the costs of the terminals and labor for attaching them to the electrical cables 12, 14. The use of carbon nanotube cables also provide another benefit besides weight savings because the carbon nanotubes are less susceptible to corrosion than metallic, e.g. copper or aluminum cables and therefore do not require sealing of the housing 20 to keep environmental contaminants from the electrical interface of the electrical cables 12, 14. This electrical connector assembly 16 and method 100 is also beneficial for aluminum cables because the elimination of terminals removes the possibility of galvanic corrosion caused by terminals made of a dissimilar metal, such as copper or brass.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector assembly, comprising:

a first connector block defining a first groove in a first end surface of the first connector block, wherein the first connector block is configured to have a first electrical conductor at least partially disposed within the first groove;

a second connector block defining a second groove in a second end surface of the second connector block, wherein the second connector block is configured to have a second electrical cable having a second conductor at least partially disposed within the second groove; and a housing configured to receive the first and second connector blocks, align the first groove of the first connector block with the second groove of the second connector block, and hold the first and second connector blocks together such that the first electrical conductor is in direct physical and electrical contact with the second conductor such that the first and second conductors are compressed, wherein the housing comprises a male portion defining a first cavity in which the first connector block is received and wherein the housing further comprises female portion defining a second cavity in which the second connector block is received and defining a shroud configured to receive the male portion.

2. The electrical connector assembly according to claim 1, wherein the male portion and the female portion have corresponding locking features configured to secure the male portion to the female portion.

3. The electrical connector assembly according to claim 1, wherein the first groove continuously extends from the first end surface to a first side surface of the first connector block adjacent the first end surface and the second groove continuously extends from the second to a second side surface of the second connector block adjacent the second end surface.

4. The electrical connector assembly according to claim 1, wherein the first connector block is identical to the second connector block.

5. The electrical connector assembly according to claim 1, wherein the housing is dimensioned such that the first and second connector blocks cause an interference fit condition between the first and second conductors.

6. The electrical connector assembly according to claim 2, wherein the first groove continuously extends from the first end surface to a first side surface of the first connector block adjacent the first end surface and the second groove continuously extends from the second to a second side surface of the second connector block adjacent the second end surface.

7. The electrical connector assembly according to claim 2, wherein the first connector block is identical to the second connector block.

8. The electrical connector assembly according to claim 2, wherein the housing is dimensioned such that the first and second connector blocks cause an interference fit condition between the first and second conductors.

9. An electrical connector assembly, comprising:

a first connector block defining a first groove in a first end surface of the first connector block, wherein the first connector block is configured to have a first electrical conductor at least partially disposed within the first groove;

a second connector block defining a second groove in a second end surface of the second connector block, wherein the second connector block is configured to have a second electrical cable having a second conductor at least partially disposed within the second groove; and a housing configured to receive the first and second connector blocks, align the first groove of the first connector block with the second groove of the second connector block, and hold the first and second connector blocks together such that the first electrical conductor is in direct physical and electrical contact with the second conductor such that the first and second conductors are compressed, wherein the housing includes a spring element configured to exert a compressive force on the first and second connector blocks, thereby causing an interference fit condition between the first and second conductors.

10. The electrical connector assembly according to claim 9, wherein the first groove continuously extends from the first end surface to a first side surface of the first connector block adjacent the first end surface and the second groove continuously extends from the second to a second side surface of the second connector block adjacent the second end surface.

11. The electrical connector assembly according to claim 9, wherein the first connector block is identical to the second connector block.

12. The electrical connector assembly according to claim 9, wherein the housing is dimensioned such that the first and second connector blocks cause an interference fit condition between the first and second conductors.

13. An electrical connector assembly, comprising:

a first connector block defining a first groove in a first end surface of the first connector block, wherein the first connector block is configured to have a first electrical conductor at least partially disposed within the first groove;

a second connector block defining a second groove in a second end surface of the second connector block, wherein the second connector block is configured to have a second electrical cable having a second conductor at least partially disposed within the second groove; and a housing configured to receive the first and second connector blocks, align the first groove of the first connector block with the second groove of the second connector block, and hold the first and second connector blocks together such that the first electrical conductor is in direct physical and electrical contact with the second conductor such that the first and second conductors are compressed, wherein the housing includes a wedge-shaped element configured to exert a compressive force on the first and second connector blocks, thereby causing an interference fit condition between the first and second conductors.

14. The electrical connector assembly according to claim 13, wherein the first groove continuously extends from the first end surface to a first side surface of the first connector block adjacent the first end surface and the second groove continuously extends from the second to a second side surface of the second connector block adjacent the second end surface.

15. The electrical connector assembly according to claim 13, wherein the first connector block is identical to the second connector block.

16. The electrical connector assembly according to claim 13, wherein the housing is dimensioned such that the first and second connector blocks cause an interference fit condition between the first and second conductors.

17. An electrical cable assembly configured for transmission of differential signals, comprising:

a first connector block defining a first pair of grooves in a first end surface of the first connector block;

a first electrical cable having a first pair of electrical conductors formed of carbon nanotubes and longitudinally twisted one about the other, wherein each conductor of the first pair of electrical conductors is separately at least partially disposed within one of the first pair of grooves;

a second connector block defining a second pair of grooves in a second end surface of the second connector block;

a second electrical cable having a second pair of electrical conductors formed of carbon nanotubes and longitudinally twisted one about the other, wherein each conductor of the second pair of electrical conductors is separately at least partially disposed within one of the second pair of grooves;

a male housing defining a first cavity in which the first connector block is received;

a female housing defining a second cavity in which the second connector block is received and defining a shroud configured to receive the male housing, wherein the male housing and the female housing cooperate to align the first pair of grooves of the first connector block with the second pair of grooves of the second connector block and hold the first and second connector blocks together such that the first pair of electrical conductors are in direct physical and electrical contact with the second pair of electrical conductors such that the first and second pairs of conductors are compressed.

18. The electrical cable assembly according to claim 17, wherein the male housing and the female housing have corresponding locking features configured to secure the male housing to the female housing.

19. The electrical cable assembly according to claim 17, wherein the first pair of grooves continuously extend from the first end surface to a first side surface of the first connector block adjacent the first end surface and wherein the second pair of grooves continuously extend from the second end surface to a second side surface of the second connector block adjacent the second end surface.

20. The electrical cable assembly according to claim 19, wherein the first pair of grooves continuously extend from the first end surface to a third side surface of the first connector block adjacent the first end surface and opposite the first side surface and wherein the second pair of grooves continuously extend from the second end surface to a fourth side surface of the second connector block adjacent the second end surface and opposite the second side surface.

21. The electrical cable assembly according to claim 17, wherein the first connector block is identical to the second connector block.

22. The electrical cable assembly according to claim 17, wherein the male housing and the female housing are dimensioned such that the first and second connector blocks cause an interference fit condition between the first and second pairs of conductors.

23. The electrical cable assembly according to claim 17, wherein the male housing and/or the female housing includes a spring element configured to exert a compressive force on the first and second connector blocks, thereby causing an interference fit condition between the first and second pairs of conductors.

24. The electrical cable assembly according to claim 17, wherein the male housing and/or the female housing includes a wedge-shaped element configured to exert a compressive force on the first and second connector blocks, thereby causing an interference fit condition between the first and second conductors.

25. A method of interconnecting a first electrical cable to a second electrical cable, comprising the steps of:

providing a first connector block defining a first groove in a first end surface of the first connector block;

providing the first electrical cable and at least partially disposing the first electrical cable within the first groove;

providing a second connector block defining a second groove in a second end surface of the second connector block;

providing the second electrical cable and at least partially disposing the second electrical cable within the second groove;

providing a housing configured to receive the first and second connector blocks, wherein the housing comprises a male portion defining a first cavity, wherein the housing further comprises female portion defining a second cavity in which the second connector block is received and defining a shroud configured to receive the male portion;

inserting the first connector block within the first cavity; and inserting the second connector block within the second cavity;

inserting the first and second connector blocks within the housing such that the first groove of the first connector block is aligned with the second groove of the second connector block;

holding the first and second connector blocks together such that the first electrical cable is in direct physical and electrical contact with the second electrical cable; and compressing the first and second conductors through the direct physical contact with one another.

26. The method according to claim 25, wherein the male portion and the female portion have corresponding locking features and wherein the method further comprises the step of securing the male portion to the female portion via the locking features.

27. The method according to claim 25, wherein the first connector block is identical to the second connector block.

* * * * *